US006237347B1

(12) United States Patent
Rigby et al.

(10) Patent No.: US 6,237,347 B1
(45) Date of Patent: May 29, 2001

(54) METHOD FOR LOADING PRESSURIZED LIQUEFIED NATURAL GAS INTO CONTAINERS

(75) Inventors: James R. Rigby, Kingwood; Brandon T. Stone, Houston, both of TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 09/522,676

(22) Filed: Mar. 10, 2000

Related U.S. Application Data

(60) Provisional application No. 60/127,203, filed on Mar. 31, 1999.

(51) Int. Cl.[7] ..... F17C 7/04

(52) U.S. Cl. ..... 62/48.1; 62/50.2; 62/137; 62/2; 137/2; 141/4; 222/3; 222/61

(58) Field of Search ..... 62/48.1, 50.2; 137/2; 141/4, 52, 242; 222/3, 61

(56) References Cited

U.S. PATENT DOCUMENTS

| | | | |
|---|---|---|---|
| 334,481 | 1/1886 | Sone | 114/74 A |
| 1,140,250 | 5/1915 | Cabot . | |
| 1,460,389 | 6/1923 | Mauclere | 222/155 |
| 1,753,785 | 4/1930 | Heylandt . | |
| 2,940,268 | 6/1960 | Morrison | 62/7 |
| 2,972,873 | 2/1961 | Peet et al. | 62/51 |
| 2,975,608 | 3/1961 | Morrison | 62/53 |
| 2,983,409 | 5/1961 | Henry | 222/399 |
| 3,066,495 | 12/1962 | Biggins et al. | 62/50 |
| 3,145,680 | 8/1964 | Farkas et al. | 114/74 |
| 3,293,011 | 12/1966 | Lewis et al. | 48/190 |
| 3,354,905 | 11/1967 | Lewis et al. | 137/590 |
| 3,365,898 | 1/1968 | Van Kleef | 62/55 |
| 3,608,324 * | 9/1971 | Singleton et al. | 62/48.1 |
| 3,690,115 | 9/1972 | Clayton | 62/49 |
| 3,783,628 | 1/1974 | Reiche | 62/55 |

(List continued on next page.)

FOREIGN PATENT DOCUMENTS 1133167 3/1967 (DE) .

OTHER PUBLICATIONS

Edward K. M. Faridany et al., "A Pressure LNG System", European Offshore Petroleum Conference & Exhibiton, Oct. 21–24, 1980, vol. EUR 171, pp. 245–254.

E. K. Faridany et al., "The Ocean Phoenix Pressure—LNG System", Gastech 1976, pp. 267–280. ( ( month of publication ot provided; year of publication is sufficiently earlier than priority date that month of publication not in issue).

R. J. Broeker, "CNG and MLG—New Natural Gas Transportation Process", pp. 138–140, American Gas Journal, Jul. 1969.

R. J. Broeker, "A New Process for the Transportation of Natural Gas", International LNG Conference, Chicago, Apr. 1968, Session No. 5, Paper No. 30.

*Primary Examiner*—Ronald Capossela
(74) *Attorney, Agent, or Firm*—Gary D. Lawson

(57) ABSTRACT

A method is disclosed for loading pressurized liquefied natural gas (PLNG) into a plurality of containers containing pressurized vapor, wherein the containers are loaded in succession. The containers may be onshore or onboard a ship or other ocean transporting vessel. As a first step, the liquefied gas is introduced into the containers, thereby discharging the vapor therefrom. Vapor discharged from the containers is passed to auxiliary storage tanks comprising a first tank and a second tank. Vapor from at least one of the tanks is withdrawn and passed to a vapor utilization means such as a liquefaction plant for liquefaction of the vapor or to an engine or turbine for use of the vapor as fuel. Fluid flow to and from the first and second tanks is regulated to assure that the total flow rate of vapor to the vapor utilization means remains at a relatively constant flow rate.

24 Claims, 4 Drawing Sheets

U.S. PATENT DOCUMENTS

| | | | | |
|---|---|---|---|---|
| 3,830,180 | | 8/1974 | Bolton | 114/74 A |
| 3,831,811 | | 8/1974 | Becker | 222/1 |
| 3,842,613 | | 10/1974 | Becker | 62/50 |
| 3,861,161 | * | 1/1975 | Cooper | 62/48.1 |
| 3,877,240 | | 4/1975 | Kniel et al. | 62/50 |
| 4,182,254 | | 1/1980 | Secord | 114/74 A |
| 4,202,180 | | 5/1980 | Cox | 62/50 |
| 4,292,909 | | 10/1981 | Conway | 114/74 R |
| 4,446,804 | | 5/1984 | Kristiansen | 114/74 R |
| 5,377,723 | | 1/1995 | Hilliard, Jr. et al. | 141/4 |
| 5,454,408 | | 10/1995 | DiBella et al. | 141/197 |
| 5,924,291 | * | 7/1999 | Weiler et al. | 62/50.2 |
| 5,950,453 | | 9/1999 | Bowen et al. | 62/612 |
| 5,956,971 | | 9/1999 | Cole et al. | 62/623 |
| 6,016,665 | | 1/2000 | Cole et al. | 62/612 |
| 6,021,848 | | 2/2000 | Breivik et al. | 166/344 |
| 6,023,942 | | 2/2000 | Thomas et al. | 62/613 |

* cited by examiner

METHOD FOR LOADING PRESSURIZED LIQUEFIED NATURAL GAS INTO CONTAINERS

This application claims the benefit of U.S. Provisional Application No. 60/127,203 filed Mar. 31, 1999.

FIELD OF THE INVENTION

This invention relates to the handling of pressurized liquefied natural gas and, more particularly, to a method for loading pressurized liquefied natural gas into containers that are filled with methane-rich vapor.

BACKGROUND OF THE INVENTION

Because of its clean burning qualities and convenience, natural gas has become widely used in recent years. Many sources of natural gas are located in remote areas, great distances from any commercial markets for the gas. Sometimes a pipeline is available for transporting produced natural gas to a commercial market. When pipeline transportation is not feasible, produced natural gas is often processed into liquefied natural gas (which is called "LNG") for transport to market.

It has been recently proposed to transport natural gas at temperatures above −112° C. (−170° F.) and at pressures sufficient for the liquid to be at or below its bubble point temperature. For most natural gas compositions, the pressure of the natural gas at temperatures above −112° C. will be between about 1,380 kPa (200 psia) and about 4,480 kPa (650 psia). This pressurized liquid natural gas is referred to as PLNG to distinguish it from LNG, which is transported at near atmospheric pressure and at a temperature of about −162° C. (−260° F.).

In co-pending United States patent application Ser. No. 09/464987 by J. R. Rigby, a process is disclosed for unloading PLNG from ship containers by pressuring out the PLNG with gas, leaving the tanks PLNG-empty but full of pressurized, methane-rich gas. At the end of the PLNG unloading method, all but the last container or group of containers are at low pressure, preferably between about 690 kPa (100 psia) and 1,380 kPa (200 psia), while the last container is at slightly above the original PLNG's bubble point pressure. Having the lower pressure vapor in the containers for the return trip or voyage substantially reduces the mass of methane left in the containers compared to having high-pressure gas contained therein. Depending upon the pressure, temperature, and composition of the PLNG, leaving high pressure vapor in all the containers could constitute from about 10 to 20 percent of the mass of the cargo in the containers before PLNG removal.

During PLNG loading, the methane-rich vapor in the containers is displaced by the entering liquid. It is desirable to liquefy at least part of the methane-rich vapor displaced from containers during PLNG loading. The vapor liquefaction is preferably integrated with the liquefaction process used to manufacture the PLNG being loaded into the containers. During the loading of a multiplicity of gas-filled containers, the flow rate of vapor leaving the containers can vary substantially between the beginning and end of the loading method. To maintain operational stability of the liquefaction plant, it is desirable that the vapor return flow rate be a relatively constant percentage of the plant feed rate. A need exists for a PLNG loading method that provides this type of vapor return flow rate.

SUMMARY

A method is disclosed for loading PLNG into a plurality of containers filled with pressurized vapor. The containers or groups of containers are loaded in succession and the PLNG introduced in a container discharges vapor therefrom. A fraction of the discharged vapor from at least one of the containers is passed into auxiliary storage tanks comprising a first tank and a second tank. Vapor is withdrawn from at least one of the tanks and passed to a vapor utilization means, preferably a liquefaction plant to liquefy the vapor or an engine or turbine that uses the vapor as fuel. The flow of PLNG and vapor to and from the first and second tanks are regulated to assure that the total flow rate of vapor to the vapor utilization means remains at a generally constant flow rate.

In a preferred embodiment of this invention, two auxiliary storage tanks, a first tank and a second tank, are used to buffer the flow rate of pressurized vapor discharged from a plurality of containers that are filled with PLNG in succession. PLNG is introduced into a first container or group of containers and vapor is discharged therefrom. A first fraction of the discharged vapor is passed to a suitable gas utilization means, such as a vapor liquefaction plant or an engine or turbine that uses the vapor as fuel, and a second fraction is passed to another container to be filled with PLNG. Vapor discharged from the last container being filled with PLNG is passed to one of the auxiliary storage tanks and the vapor from the auxiliary storage tanks is then passed to any suitable vapor utilization means. Fluid flow (vapor and PLNG) to and from the storage tanks is regulated to buffer the flow rate of vapor to the vapor utilization means. At the beginning of the PLNG-loading method, the first tank is full of relatively high-pressure vapor and the second tank contains pressurized liquefied gas. During filling of the first container or first group of containers, PLNG is withdrawn from the second tank and passed to the first container or first group of containers and simultaneously vapor is withdrawn from the first tank, pressurized, and a first fraction of the pressurized vapor is passed to the second tank and a second fraction of the pressurized vapor is heated and returned to the first tank. When the second tank is emptied of PLNG, the second tank contains relatively high-pressure vapor and the first tank contains relatively low-pressure vapor. Vapor from the second tank is then withdrawn, pressurized, and a fraction of the pressurized vapor is passed to a vapor utilization means and a second fraction of the pressurized vapor is heated and returned to the second tank. At the end of the foregoing step, the first and second tanks both contain vapor at a relatively low pressure. During PLNG filling of the last container or last group of containers, vapor discharged from the last container or group is passed to a compressor for pressurization, and a first fraction of the pressurized vapor is passed to the vapor utilization means and a second fraction of the pressurized vapor is heated and passed to the second tank. When the last container is filled with PLNG, the first tank contains vapor at a relatively low pressure and the second tank contains vapor at a relatively high pressure. The second tank is then ready to be replenished with PLNG. PLNG is then introduced into the second tank and vapor discharged therefrom. The discharged vapor is split into a first fraction and a second fraction. The first vapor fraction is heated and passed to the first tank and the second fraction is passed to the gas utilization means. At the end of this step, the first tank contains vapor at a relatively high-pressure and the second tank contains PLNG. The storage tanks are now ready for PLNG-loading another set of containers.

BRIEF DESCRIPTION OF THE DRAWINGS

The present invention and its advantages will be better understood by referring to the following detailed description and the attached drawings.

Figure 1A:
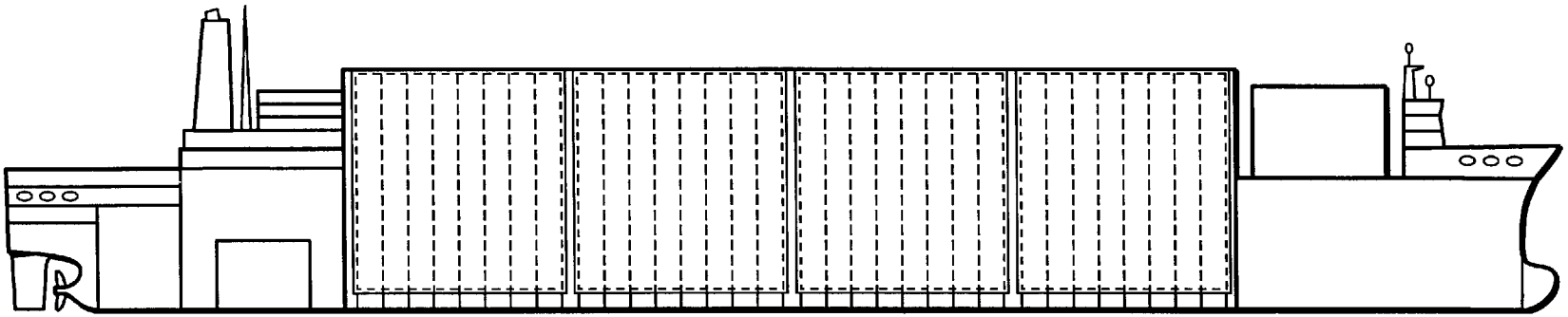
FIGS. 1A and 1B show a ship suitable for transporting PLNG in side view and plan view, both views in partial sections, illustrating a multiplicity of containers to be filled with PLNG in accordance with the method of this invention.

The drawings illustrate a specific embodiment of practicing the method of this invention. The drawings are not intended to exclude from the scope of the invention other embodiments that are the result of normal and expected modifications of the specific embodiment. Various required subsystems such as pumps, valves, flow stream mixers, control systems, and fluid level sensors have been deleted from the drawings for the purposes of simplicity and clarity of presentation.

DETAILED DESCRIPTION OF THE INVENTION

This invention provides a method for loading pressurized liquefied natural gas (referred to herein as "PLNG") into a series of containers, such as containers on a ship or storage barge, where at least some of the containers are filled with pressurized methane-rich vapor. The term "container" is used in this description to mean any pressurizable receptacle such as a flask, bottle, cylinder, tank, or the like, that is suitable for transporting PLNG. The piping between the containers can be so arranged that the containers can be loaded with PLNG one container at a time in succession or loaded in groups, and any container in a series or any group can be loaded or filled in any sequence. In this description, references to serially loading the containers should also be understood as including the option of loading groups of containers in succession. The optimum sequence for filling containers or groups of containers on a floating carrier should take into account the trim and stability of the carrier, which can be determined by those skilled in the art. The auxiliary storage tanks described herein comprise one or more storage containers that may be the same size or different sizes than the containers on the ship or other transportation or storage means.

In this description, it is assumed that all of the containers at the beginning of the PLNG loading method are filled with residual methane-rich vapor resulting from a PLNG unloading operation. During PLNG-filling of a given container, a fraction of the vapor displaced from the given container by the PLNG is used to pressurize vapor in another container to be filled with PLNG, except when filling the last container in the series. When filling the last container with PLNG, vapor from the last container can not be introduced into another container since the other containers on the ship are already filled with PLNG. It is desirable to utilize the vapor removed from the ship, preferably in the same liquefaction plant used to manufacture the PLNG.

It is further desirable that the flow rate of return vapor to the liquefaction plant be a relatively constant percentage of the plant inlet rate. This is desirable to keep the specifications of the PLNG constant and to maintain plant operations at or near steady state conditions. Without auxiliary storage the plant could see a spike of between 10 and 25% of its inlet stream flow rate when the last container is filled. The implications of this spike could require lowering the inlet stream flow rate to the plant, or overdesigning the plant to handle this relatively short duration spike (about 10% of the time). The spike of the methane-rich return vapor stream could also change the product PLNG composition and properties. The inventors have discovered a novel PLNG loading system that uses auxiliary storage tanks to maintain a relatively constant flow rate of the methane-rich return vapor to a liquefaction plant or other suitable vapor utilization means.

The invention will be described with reference to the drawings, wherein flow lines, containers, and tanks, compressors and other equipment with like numerals have the same process functions. Those skilled in the art will recognize, however, that the flow lines from one container to another may vary in size and capacity to handle different fluid flow rates and temperatures.

Figure 1B:
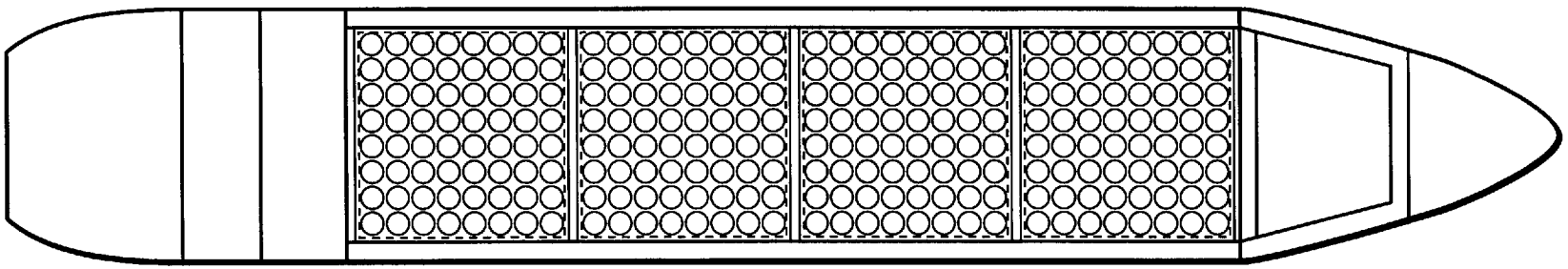

In a preferred embodiment of this invention, PLNG is loaded into containers onboard a ship, generally shown in FIGS. 1A and 1B. FIG. 1A shows a side view of a suitable ship having a multiplicity of vertically elongated containers or bottles for transporting PLNG. FIG. 1B shows a plan view of the same ship with a section of the deck removed to show the containers, which appear as round circles. It should be understood, however, that the practice of this invention is not limited to a particular design of a container to be unloaded. Nor is the practice of this invention limited to containers on ships, barges, or other water transporting vessels. Any suitable container for storage of PLNG may be used in the PLNG loading method of this invention, whether on a ship or an onshore facility. While FIGS. 1A and 1B show a plurality of vertically elongated containers on a ship, the containers could also be horizontal, and the containers could have some other suitable shape such as spherical.

The containers are connected to a piping system for selectively loading, venting, and discharging container fluids. The piping used to load the containers and to pass vapor from one container to another could be modified from that schematically illustrated in the drawings in accordance with the teachings of this invention depending on the placement of the containers and applicable regulations of regulatory bodies. In this description of the invention all of the PLNG loading and vapor handling is through the top of the containers. Although not shown in the Figures, liquid loading and unloading could be handled with bottom connections.

The elongated containers shown in FIGS. 1A and 1B are shown mounted within the ship's hold. The containers can be contained in a cold box that has suitable insulation for keeping the PLNG at cryogenic temperatures. Alternatively, each container can be individually insulated. Each container will typically range from about 15 to 60 meters in height and range from about 3 to 10 meters in outside diameter; however, the container size is not a limiting factor in this invention. The containers can be fabricated of any suitable material capable of enduring exposure and stress at cryogenic temperatures at the pressures required to keep PLNG at or below its bubble point temperature.

The term "bubble point" as used in this description means the temperature and pressure at which a liquid begins to convert to gas. For example, if a certain volume of PLNG is held at constant pressure, but its temperature is increased, the temperature at which bubbles of gas begin to form in the PLNG is the bubble point. Similarly, if a certain volume of PLNG is held at constant temperature but the pressure is reduced, the pressure at which gas begins to form defines the bubble point pressure at that temperature. At the bubble point, the liquefied gas is saturated liquid. For most natural gas compositions, the bubble point pressure of the natural gas at temperatures above −112° C. will be between about 1,380 kPa (200 psia) and about 4,480 kPa (650 psia).

The term natural gas as used in this description means a gaseous feed stock suitable for manufacturing PLNG. The natural gas could comprise gas obtained from a crude oil well (associated gas) or from a gas well (non-associated gas). The composition of natural gas can vary significantly. As used herein, a natural gas stream contains methane ($C_1$) as a major component. The natural gas will typically also contain ethane ($C_2$), higher hydrocarbons ($C_{3+}$), and minor amounts of contaminants such as water, carbon dioxide, hydrogen sulfide, nitrogen, dirt, iron sulfide, wax, and crude oil. The solubilities of these contaminants vary with temperature, pressure, and composition. If the natural gas stream contains heavy hydrocarbons that could freeze out during liquefaction or if the heavy hydrocarbons are not desired in PLNG because of compositional specifications or their value as natural gas liquids (NGLs), the heavy hydrocarbons are typically removed by a fractionation process prior to liquefaction of the natural gas. At the operating pressures and temperatures of PLNG, moderate amounts of nitrogen in the natural gas can be tolerated since the nitrogen can remain in the liquid phase with the PLNG. Since the bubble point temperature of PLNG at a given pressure decreases with increasing nitrogen content, it will normally be desirable to manufacture PLNG with a relatively low nitrogen concentration.

The minimum temperature of PLNG to be loaded in accordance with the method of this invention will be above about −112° C. (−170° F.). The maximum temperature of the PLNG to be loaded will depend primarily on the PLNG's composition. Natural gas, which is predominantly methane, cannot be liquefied at ambient temperature by simply increasing the pressure, as is the case with heavier hydrocarbons used for energy purposes. The critical temperature of methane is −82.5° C. (−116.5° F.). This means that methane can only be liquefied below that temperature regardless of the pressure applied. Since natural gas is a mixture of hydrocarbons, it liquefies over a range of temperatures. The critical temperature of natural gas is typically between about −85° C. (−121° F.) and −62 ° C. (−80° F.). This critical temperature will be the theoretical maximum temperature of PLNG loaded into the containers, but the preferred storage temperature will preferably be several degrees below the critical temperature and at a pressure lower than the critical pressure.

Figure 2:
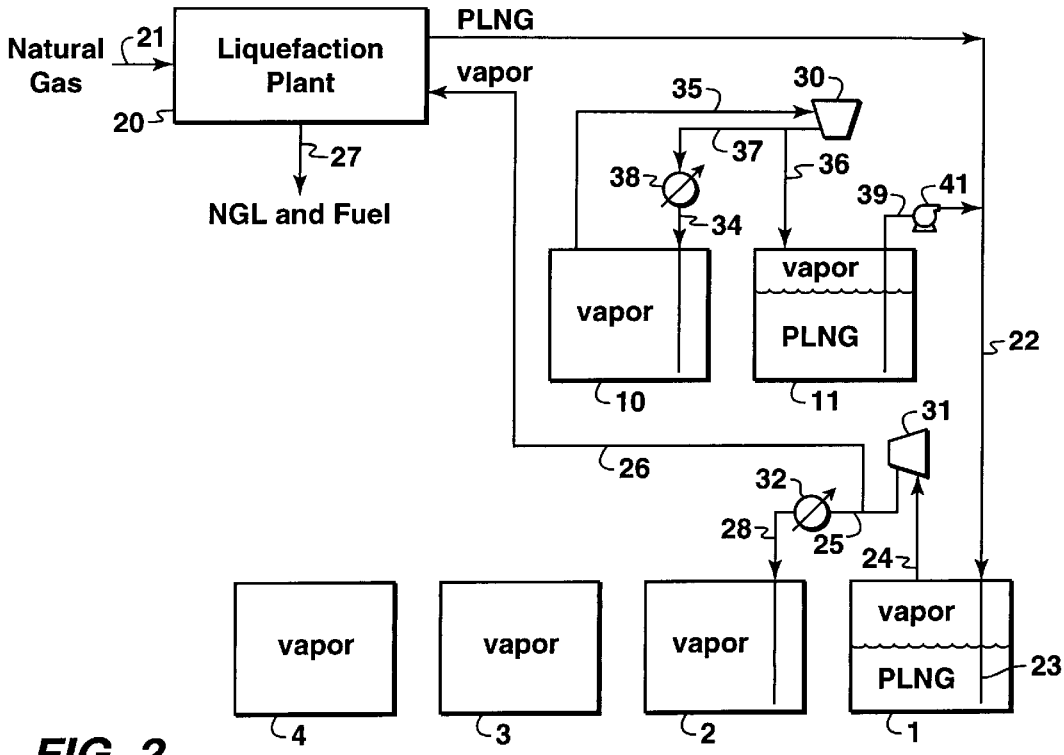
FIG. 2 is a schematic flow diagram for loading PLNG into a first container or group of containers in a series, such as containers on a ship as shown in FIGS. 1A and 1B.
Figure 3:
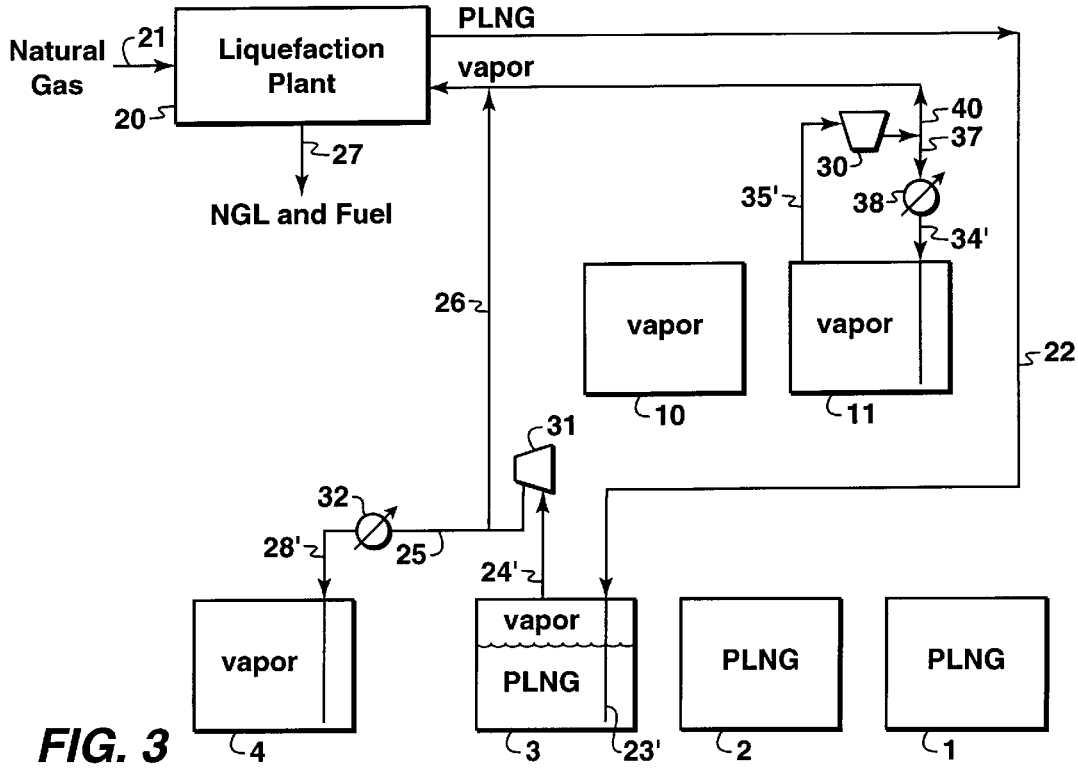
FIG. 3 is a schematic flow diagram, similar to FIG. 2, for loading PLNG into another container in the series of containers.
Figure 4:
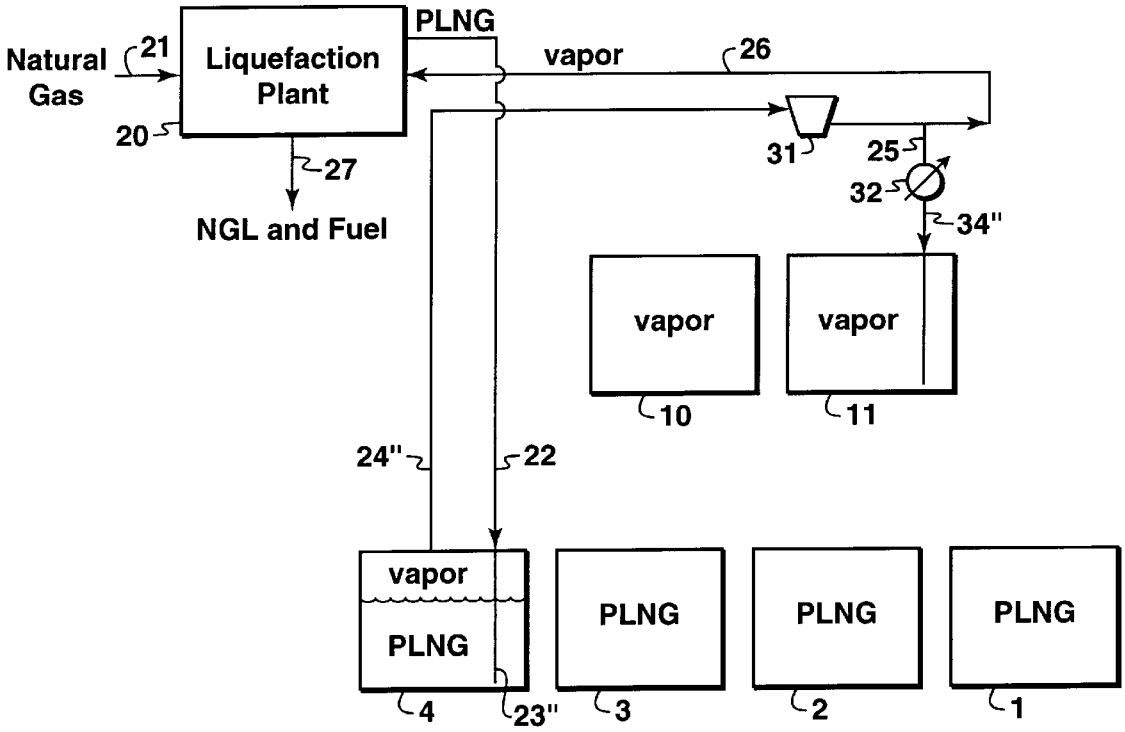
FIG. 4 is a schematic flow diagram, similar to FIG. 2, for loading PLNG into the last container of the series of containers.

A preferred embodiment of the invention will now be described with reference to FIGS. 2 through 5 which illustrate schematic flow diagrams of three stages of filling a multiplicity of containers in succession with PLNG. The containers to be filled with PLNG in accordance with the method of this invention can be located onshore or on floating vessels, such as a ship shown in FIGS. 1A and 1B. FIGS. 2, 3, and 4 illustrate one example of fluid communication between a liquefaction plant 20, auxiliary storage tanks 10 and 11, and containers 1, 2, 3, and 4 which are to be filled with PLNG in accordance with the method of this invention. FIG. 2 illustrates loading of PLNG into container 1 and pressurizing container 2 for PLNG-loading, FIG. 3 illustrates loading container 3 with PLNG and pressurizing container 4 for PLNG-loading, and FIG. 4 illustrates loading container 4 and handling of vapor displaced from container 4.

Referring to FIG. 2, a liquefaction plant 20 receives natural gas by line 21 and liquefies at least a portion of the gas to produce a PLNG product stream 22. The liquefaction plant 20 will also typically produce fuel and heavier hydrocarbon constituents of the natural gas, which are called natural gas liquids (NGL). NGL can include ethane, propane, butane, pentane, isopentane and higher hydrocarbons, some of which could be used as make-up refrigerants for one or more closed-cycle refrigeration systems used in the liquefaction plant 20. Examples of suitable liquefaction systems for producing PLNG are described in U.S. Pat. Nos. 6,023,942; 6,016,665; 5,950,453; and 5,956,971. The containers to be filled with PLNG in accordance with this invention are shown as having reference numerals 1, 2, 3, and 4. While the loading method of this invention will be described herein using four containers, this invention is not limited to a particular number of containers. A ship designed for transporting PLNG could have several hundred pressurizable cylinders to be PLNG-loaded. The containers can be loaded one container at a time or the containers can be loaded in groups of several containers.

Auxiliary storage tanks 10 and 11 are used in the practice of this invention to buffer the flow rate of vapor to the liquefaction plant 20 during loading of containers 1, 2, 3, and 4. Tanks 10 and 11 can be any suitable pressurizable receptacle for storage of PLNG and methane-rich vapor at the temperatures and pressures of PLNG. The optimum volumetric capacity of tanks 10 and 11 will depend on the amount of PLNG to be loaded into the containers, the volumetric capacity of the last container or group of containers being filled, and the desired PLNG loading time for the containers. Tank 10 and tank 11 each preferably has a volumetric capacity approximately the same as the volumetric capacity of the largest container to be loaded with PLNG, and more preferably a slightly larger volumetric capacity than the largest container. Having benefit of the teachings in this description, one skilled in the art could optimize the size of tanks 10 and 11. Tanks 10 and 11 are preferably positioned inside an insulated cold box to reduce heat transfer from the tanks' surroundings to the tanks' contents, however, the tanks may also be individually insulated. The tanks are preferably located near-shore on a barge but they can be located onshore. Although only two auxiliary storage tanks are shown in the drawings, storage tanks 10 and 11 could each comprise a multiplicity of containers piped together.

Containers 1, 2, 3, and 4 as well as tanks 10 and 11 are preferably provided with pressure relief valves, pressure and temperature sensors, fluid level indicators, pressure alarm systems and suitable insulation for cryogenic operation. These systems are omitted from the drawings since those skilled in the art are familiar with the construction and operation of such systems, which are not essential to understanding the practice of this invention.

In this description of the preferred embodiment, it is assumed that the PLNG ship arrives at a loading terminal with the containers full of residual vapor resulting from a PLNG unloading operation. It is further assumed that the container 1 was the last container emptied of PLNG in the unloading operation, and it contains vapor at approximately the same pressure as, and preferably a slightly higher pressure than, the pressure of PLNG to be loaded in container 1. It is still further assumed that the vapor pressure in the other containers (containers 2, 3, and 4 in FIG. 2) is substantially lower than the vapor pressure in container 1. However, this invention is not limited to the vapor pressure conditions that are assumed in this description. The vapor pressure could for example range from ambient pressure to a pressure slightly above the bubble point pressure of PLNG. As disclosed in co-pending U.S. patent application Ser. No. 09/464987 by J. R. Rigby, when unloading PLNG from containers at an import terminal, it is desirable to leave the last container at the pressure of the departing PLNG to facilitate future loading of PLNG at the export terminal. The other containers preferably have vapor at a relatively low pressure to reduce the mass of methane-rich cargo being returned with the ship.

After the PLNG unloading operation, the containers are preferably kept at a relatively constant temperature for the return trip or voyage, preferably at substantially the same temperature as the bubble point temperature of the produced PLNG. Significant fluctuation in the temperature of the containers could cause undesirable thermal stresses in the container materials and difficulties could arise from expansion and contraction of the containers, manifold systems, and container support systems. The vapor in the containers can be maintained at a relatively constant temperature during the ship's return voyage by any suitable means. For example, a reliquefaction system could provide refrigeration duty for cooling the residual vapor in the containers during the return voyage by extracting vapor from the containers, reliquefying it, and spraying it back into the containers. This method could also be used to maintain the header system at the operating temperature, thereby reducing preparation time for loading at the export terminal.

If the first container to be filled with PING (container 1 in FIG. 2) contains vapor at a temperature significantly higher than the temperature of PLNG to be loaded therein, the vapor temperature can be reduced by any suitable means before PLNG loading commences or in the loading process. The larger the temperature differences between a higher temperature vapor in a container and the PLNG temperature, the larger the amount of undesirable boil-off vapor that will be produced as the PLNG enters the container. Suitable processes for reducing a container's inside temperature would be familiar to those skilled in the art.

If container 1 is filled with vapor at a pressure significantly lower than the bubble point pressure of the PLNG as the liquid enters the bottom of container 1, to avoid the possibility of PLNG flashing during the loading operation, the vapor pressure in container 1 can be increased by any suitable means. For example, vapor from storage tank 10 could be introduced into container 1 until the vapor pressure therein is substantially the same as the PLNG's bubble point pressure, and preferably slightly higher than the bubble point pressure.

Referring to FIG. 2, once the vapor pressure and vapor temperature in container 1 are near the pressure and temperature of PLNG to be loaded therein, PLNG is passed through line 22 and through feed tube 23 that introduces the PLNG to the bottom of container 1. It is desirable to keep the pressure of the PLNG above the bubble point of the liquid during loading. Therefore, the pressure is maintained essentially constant at the bottom of the container at the bubble point pressure of the PLNG plus static head of the PLNG in container 1 when it is full of liquid. In this manner, the pressure at the top of the container fill tube is at least the bubble point pressure of the PLNG and no vapor is formed in the flow lines during loading. As PLNG enters container 1, vapor contained therein is vented in a regulated manner through the top of container 1 into line 24. The pressure of the vapor can be regulated by any suitable fluid flow regulating device (not shown in the drawings) to keep the pressure of the PLNG at the bottom of the container 1 essentially constant.

One fraction of the vapor displaced from container 1 is preferably passed to the liquefaction plant 20 by line 26 (or optionally the vapor can be used in whole or part as fuel for powering turbines or engines not shown in the drawings), and another fraction of the vapor from container 1 is passed by lines 25 and 28 to container 2.

FIG. 2 shows the vapor fraction being passed to the liquefaction plant 20 after the vapor in line 24 has been further pressurized by compressor 31. Compressor 31 can be located on the ship or at a terminal or it can be a compressor used in the liquefaction plant 20. Although not shown in the FIG. 2, the vapor stream in line 26 could optionally be withdrawn from line 24 before compressor 31 further pressurizes the vapor. Sending the vapor stream to plant 20 without first being further pressurized by compressor 31 may be desirable, for example, if such pressurization is more economically performed in the liquefaction plant 20 or if the vapor stream can be used in the plant 20 without further pressurization. Although not shown in the drawings, the vapor stream in line 26 may optionally be passed to a liquefaction system that is independent of liquefaction plant 20 for liquefying the vapor stream, and the resulting liquid could then be pumped to a higher pressure and mixed with PLNG output from liquefaction plant 20.

Before the vapor in line 25 enters container 2, at least part of the vapor is heated if necessary, in order to maintain the temperature of the vapor in container 2 above the minimum design temperature of the container material. From the compressor 31, the vapor fraction in line 25 is passed to heat exchanger 32 wherein the vapor stream is heated by indirect heat exchange with any suitable heat transfer medium. Nonlimiting examples of suitable heat sources may include exhaust gases from ship engines and environmental sources such as air, salt water, and fresh water. From heat exchanger 32, the heated vapor is introduced to container 2 by line 28. Although not shown in FIG. 2, a suitable regulating device, preferably located in line 25, regulates the flow rate of vapor into container 2. The flow rate and pressure of the vapor stream passed into container 2 are preferably controlled to have the filling of container 1 completed at essentially the same time that container 2 is suitably pressurized for immediate PLNG filling.

In the early stage of PLNG-filling container 1, the vapor pressure in line 24 is sufficiently high to increase the pressure of vapor in container 2 without using compressor 31. In the early stage of filling container 1, the compressor is therefore not required and the fraction of vapor to be passed to container 2 could optionally by-pass compressor 31 and could be sent directly to the heat exchanger 32. In the late stage of PLNG-filling of container 1, the vapor stream in line 24 gradually decreases until near the end of the PLNG filling operation, the vapor pressure would not be sufficient to pressure up container 2 to the desired pressure without further pressurization by compressor 31.

In the early stage of pressurizing the vapor in container 2, to keep the temperature of the vapor in container 2 above the material design limits, the incoming vapor would need to be warmed to compensate for the drop in temperature caused by the isenthalpic pressure reduction in passing from the relatively high-pressure condition in container 1 to the relatively low-pressure condition in container 2. During the late stage of PLNG-filling of container 1, the pressure of vapor in container 2 approaches the relatively high pressure of vapor in container 1, thus the temperature drop is minimal. Therefore, in the late stage of PLNG-filling of container 1, vapor pressurized by compressor 31 could optionally by-pass the heat exchanger 32 and be sent directly to container 2. The foregoing description of an optional vapor flow stream that by-passes compressor 31 in the early stage of PLNG-filling of container 1 and an optional flow stream that by-passes the heat exchanger 31 in the late stage of PLNG-filling of container 1 are not shown in the drawings.

The source of the PLNG for PLNG-filling of container 1 is in part obtained from auxiliary tank 11. At the beginning of the PLNG loading operation, PLNG from auxiliary tank 11 is withdrawn from tank 11 through line 39, pumped to a higher pressure by pump 41, and combined with plant PLNG in line 22. The combined PLNG stream is then passed into container 1. The flow rate of PLNG from tank 11 is regulated by suitable control devices not shown in the drawings to ensure that tank 11 is essentially emptied of PLNG before container 4 is filled with PLNG, and preferably tank 11 is emptied of PLNG before approximately half of the containers are loaded with PLNG.

Referring again to FIG. 2, during the emptying of PLNG from tank 11, vapor previously stored in storage tank 10 is transferred to tank 11 to fill the space left by the departing PLNG. To minimize flashing of the PLNG, the pressure of the vapor above PLNG in tank 11 is at least maintained at the same pressure as the bubble point pressure of the PLNG in the tank, and preferably at a pressure slightly above the bubble point pressure of the PLNG. Vapor is withdrawn from tank 10 through line 35 and passed through a compressor 30 to pressurize the vapor to the relatively high vapor pressure in tank 11. The pressurized vapor exits the compressor 30 and is separated into two streams 36 and 37. Stream 36 is passed to tank 11 and stream 37 is passed through a heat exchanger 38 to heat the compressed vapor stream 37 before it is passed back to tank 10 through line 34. Any suitable heat transfer medium may be used in heat exchanger 38 for indirect heat exchange with the compressed vapor in line 37. Nonlimiting examples of suitable heat sources may include exhaust gases from ship engines and environmental sources such as air, salt water, and fresh water. Heat exchanger 38 is shown as a separate heat exchanger from heat exchanger 32, but one heat exchanger could be used to separately heat the vapor in lines 25 and 37. From heat exchanger 38, the heated vapor is introduced to tank 10 at a rate that maintains the vapor temperature in tank 10 above the tank design temperature as tank 10's pressure is lowered. While the flow rate of gas through line 36 is relatively constant, the flow rate of the recycle warming vapor in line 37 is variable depending on the heating needs to keep tank 10 above the minimum design temperature. During the loading process the plant maintains an inlet flow of gas through line 21 and produces fuel or NGLs through line 27. Containers 3 and 4 remain essentially inactive in FIG. 2 except for boil-off.

FIG. 3 shows a schematic flow diagram of flow lines for loading PLNG into container 3 in accordance with a preferred embodiment of this invention. In the schematic shown in FIG. 3, it is assumed that containers 1 and 2 have been filled with PLNG. As PLNG is introduced to the bottom of container 3 through line 23', vapor above the PLNG in container 3 is forced out through line 24'. The vapor in line 24' is compressed by the compressor 31, and a fraction is passed by line 25 to heat exchanger 32 and it is then passed into container 4 through line 28'. A fraction of the vapor exiting container 3 is passed to plant 20 by line 26, and as discussed above with respect to vapor exiting container 1, the vapor to be sent to the plant can be withdrawn either before or after compressor 31. All of containers are filled with PLNG in succession using the same PLNG loading, vapor venting, and vapor pressurization steps described herein until the last container is to be filled with PLNG. Detailed descriptions of the flow lines and operation of tank 11 are contained in the description below of FIG. 5D.

FIG. 4 shows the principal equipment used in the method of this invention for loading PLNG into container 4, the last container in the series of containers loaded in this description. PLNG is passed from the liquefaction plant 20 by line 22 to the bottom of container 4 by pipe 23". Vapor is vented from container 4 at a controlled rate to provide a pressurized vapor cushion above the PLNG as the liquid enters the bottom of container 4. The vapor from container 4 is passed by line 24" to compressor 31. From compressor 31 the vapor is split into two streams. A first stream passes through line 26 to the liquefaction plant 20 and a second stream passes through line 25, through heat exchanger 32 for warming of the second stream and it is then passed into tank 11 by line 34". The vapor is heated to maintain a vapor temperature in tank 11 above a predetermined material design temperature. Vapor is introduced into container 11 until the vapor pressure therein is essentially the same as the bubble point pressure of the PLNG plus the liquid head of a full container.

Figure 5A:
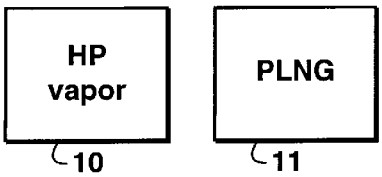
FIGS. 5A, 5B, 5C, 5D, 5E, 5F, and 5G illustrate auxiliary storage tanks at different stages of loading PLNG into a series of containers in accordance with the method of this invention.
Figure 5E:
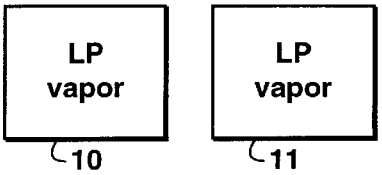
Figure 5B:
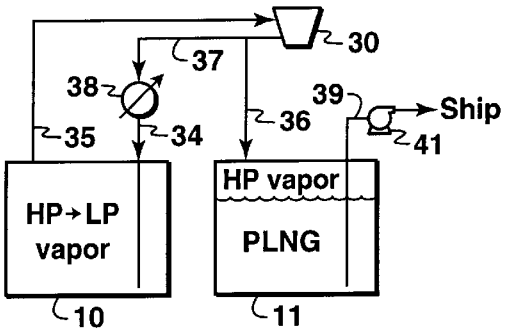
Figure 5F:
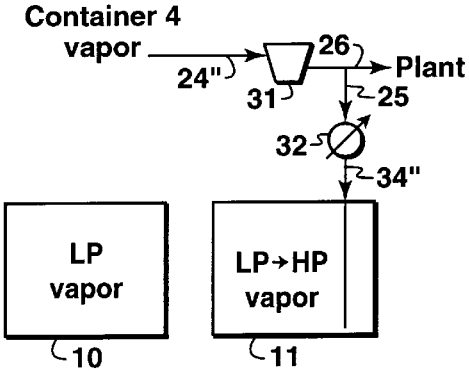
Figure 5C:
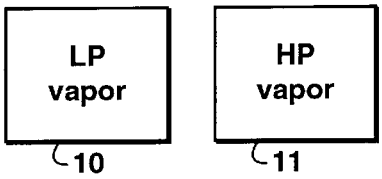
Figure 5G:
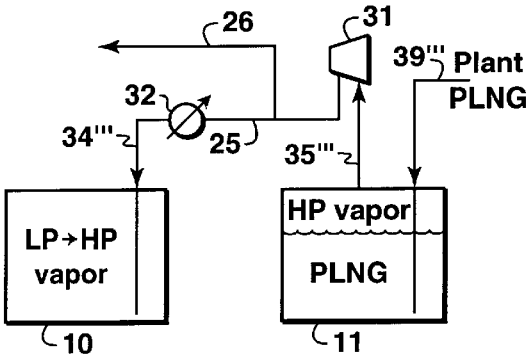
Figure 5D:
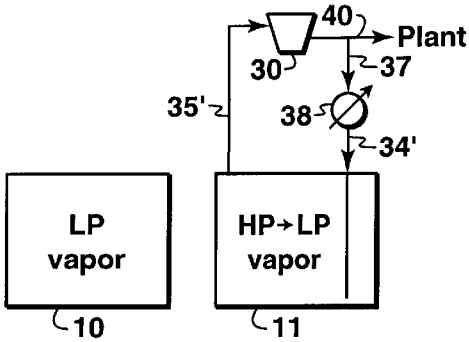

FIGS. 5A through 5G show in schematic form the condition of the auxiliary storage tanks 10 and 11 during different stages of loading PLNG into a multiplicity of containers in accordance with the practice of this invention. In these drawings, the symbol "LP" means relatively low pressure, for example 100 psia, and the symbol "HP" means relatively high pressure, for example the bubble point pressure of PLNG. The symbol "LP→HP" (used in FIGS. 5F and 5G) means that tank 11 of FIG. 5F and tank 10 of FIG. 5G are undergoing an increase in pressure during the stage shown in the applicable figure, and similarly the symbol "HP→LP" (used in FIGS. 5B and 5D) means that tank 10 of FIG. 5B and tank 11 of FIG. 5D are undergoing a decrease in pressure.

FIG. 5A illustrates the condition of the tanks 10 and 11 when a ship first arrives for filling with PLNG, before any PLNG loading has taken place. Tank 10 is filled with high pressure vapor that is rich in methane, preferably a pressure substantially the same as the bubble point pressure of PLNG, and tank 11 is filled with PLNG at substantially the same pressure and temperature conditions as PLNG to be loaded into containers on the ship.

FIG. 5B illustrates the condition of tanks 10 and 11 during loading of container 1 during the loading stage illustrated in FIG. 2. Vapor in tank 10 is being withdrawn and compressed, one portion is passed to tank 11 to displace the PLNG from that tank and another portion is heated and returned to tank 10. As tank 11 is emptied of PLNG, the pressure in tank 10 decreases from the bubble point pressure of PLNG to a relative low pressure.

FIG. 5C illustrates the conditions of tanks 10 and 11 at the stage when tank 11 has been depleted of PLNG. Tank 10 is full of low pressure vapor and tank 11 is full of high pressure vapor.

FIG. 5D illustrates removing vapor from tank 11 and passing at least some of the withdrawn vapor by line 40 to a liquefaction plant, and optionally using a fraction of this vapor as fuel. FIG. 5D illustrates the condition of tanks 10 and 11 during PLNG-loading of container 3 as illustrated in FIG. 3. The vapor drawn from tank 11 through line 35' is compressed by compressor 30, split into two streams, one being stream 37 which is heated by heat exchanger 38 and returned to tank 11 by line 34' to ensure that the vapor temperature in tank 11 doesn't fall below the minimum design temperature for the tank, the other stream 40 returning to the plant. During this stage, the vapor pressure in tank 11 is reduced.

FIG. 5E illustrates the conditions of tanks 10 and 11 after the vapor withdrawal step of FIG. 5D has been completed—both tanks 10 and 11 are filled with low-pressure vapor.

FIG. 5F illustrates the condition of tanks 10 and 11 corresponding to the stage of the filling method shown in FIG. 4. In this stage, container 4 is being filled with PLNG and high-pressure vapor from container 4 is being passed to compressor 31 where the vapor is further pressurized. One fraction of the pressurized vapor is warmed and passed into container 11 by line 34" to increase the vapor pressure therein. A second fraction of the pressurized vapor is passed by line 26 to liquefaction plant 20. During this stage, the vapor pressure in tank 11 is gradually increased and the temperature of the vapor in tank 11 is maintained relatively constant at approximately the original bubble point temperature of the PLNG.

FIG. 5G illustrates the stage of replenishing PLNG in tank 11 after the ship has been filled of PLNG to prepare tanks 10 and 11 for loading another ship with PLNG. This stage occurs after container 4 has been filled with PLNG. The PLNG source for replenishing tank 11 is preferably the liquefaction plant 20. PLNG is introduced into the bottom of tank 11 by line 39'" and the high pressure vapor above the PLNG is vented out of tank 11 through line 35'" in a regulated manner so as to maintain the pressure of the PLNG at the bottom of tank 11 relatively constant. The filling of tank 11 is similar to the loading of container 1 as described above. The vapor displaced from tank 11 is passed by line 35'" to compressor 31 to pressurize the vapor to recover pressure losses associated with frictional losses in the fluid handling equipment in transporting vapor from tank 11 to tank 10 and to provide pressure needed to pressurize vapor introduced into tank 10 by line 25 through heat exchanger 32 and through line 34'" to substantially the bubble point pressure of PLNG plus the liquid head of a container fall of PLNG. A portion of the pressurized vapor is passed by line 26 to the liquefaction plant 20. Optionally, the fraction of vapor being passed to the plant can be withdrawn from a vapor flow line upstream of the compressor 31. At the end of this stage, tank 11 is filled with PLNG and tank 10 is filled with high-pressure vapor, the condition of tanks 10 and 11 as depicted in FIG. 5A.

EXAMPLE

A hypothetical mass and energy balance was carried out to illustrate the embodiment illustrated in the FIGS. 2–4, and the results are set forth in Tables 1–4 below.

The data presented in the Tables are offered to provide a better understanding of the pressure and temperature of flow streams shown in FIGS. 2–4, but the invention is not to be construed as unnecessarily limited thereto. Table 1 provides compositional data for the container cargo at various conditions. The compositions are nominal and vary as a function of time in the loading method. Each of the containers was assumed to have a capacity of 828 $m^3$ and to have an elevation difference of 46 meters from the top of the container to its bottom. It should be noted that the PLNG loading rates would affect these compositions. Table 2 provides data for flow lines associated with FIG. 2, Table 3 provides data for flow lines associated with FIG. 3, and Table 4 provides data for flow lines associated with FIG. 4. The temperatures, pressures, and compositions are not to be considered as limitations upon the invention that can have many variations in cargo compositions and flow rates in view of the teachings herein. In this example, liquid-filled containers were filled to 98% by volume liquid (PLNG) with 2% vapor space and the ship's cargo was divided into ten equal-sized blocks of containers with each block consisting of 24 containers; the volumetric capacity of each block was approximately 20,000 $m^3$ and the total volumetric capacity of the two equal-sized storage tanks was also approximately 20,000 $m^3$.

In this example, the combined total vapor return flow rate to the liquefaction plant, or other suitable vapor utilization means, through lines 26 and 40 was held constant as a percentage of plant 20's inlet feed stream (stream 21). Several factors were considered in determining the constant vapor return flow rate, including the amount of vapor remaining in the containers prior to loading the ship; environmental conditions; and the temperature of the containers and the auxiliary storage tanks before PLNG filling began. By assessing these conditions, one skilled in the art having the benefit of the teachings of this invention can use storage tanks 10 and 11 as a buffering system to achieve a relatively constant return vapor flow rate to the liquefaction plant 20.

TABLE 1

Molar percentage of components at various container conditions

| Component | PLNG-Filled Container or Tank | High-Pressure Vapor Composition | Low-Pressure Vapor Composition |
|---|---|---|---|
| $C_1$ | 93.86 | 98.716 | 98.70 |
| $C_2$ | 4.01 | 0.82 | 0.76 |
| $C_3$ | 0.28 | 0.03 | 0.03 |
| $C_{4i}$ | 0.43 | 0.03 | 0.07 |
| $C_{4n}$ | 0.13 | 0.008 | 0.02 |
| $C_{5i}$ | 0.18 | 0.01 | 0.04 |
| $C_{5n}$ | 0.05 | 0.003 | 0.01 |
| $C_{6+}$ | 0.05 | 0.003 | 0.01 |
| $CO_2$ | 1.01 | 0.38 | 0.36 |
| Temperature ° C. (° F.) | −95 (−139) | −95 (−139) | −95 (−139) |
| Pressure at bottom of a container during PLNG filling. kPa (psia) | 2999 (435) | 2999 (435) | 876 (127) |

TABLE 2

| Stream | Percent of PLNG loaded into container 1 | Percent of PLNG in tank 11 | Vapor/ Liquid | ° C. | ° F. | kPa | psia |
|---|---|---|---|---|---|---|---|
| 23 @ bottom* | 0 | 98 | L | −95 | −139 | 2,999 | 435 |
| 24 | 0 | 98 | V | 95 | −139 | 2,999 | 435 |
| 28 | 0 | 98 | V | −96 | −140 | 876 | 127 |

TABLE 2-continued

| Stream | Percent of PLNG loaded into container 1 | Percent of PLNG in tank 11 | Vapor/ Liquid | ° C. | ° F. | kPa | psia |
|---|---|---|---|---|---|---|---|
| 35 | 0 | 98 | V | −95 | −139 | 2,999 | 435 |
| 36 | 0 | 98 | V | −96 | −140 | 2,848 | 413 |
| 34 | 0 | 98 | V | 10 | 50 | 2,999 | 435 |
| 23 @ bottom* | 49 | 88 | L | 95 | −139 | 2,999 | 435 |
| 24 | 49 | 88 | V | −95 | −139 | 2,910 | 422 |
| 28 | 49 | 88 | V | −96 | −140 | 2,158 | 313 |
| 35 | 49 | 88 | V | 95 | −139 | 2,785 | 404 |
| 36 | 49 | 88 | V | −92 | −134 | 2,861 | 415 |
| 34 | 49 | 88 | V | 10 | 50 | 2,785 | 404 |
| 26 | 49 | 88 | V | −91 | −132 | 3,103 | 450 |
| 22 | 49 | 88 | L | −96 | −140 | 3,103 | 450 |
| 39 | 49 | 88 | L | −95 | −139 | 2,827 | 410 |
| 23 @ bottom* | 98 | 78 | L | −95 | −139 | 2,999 | 435 |
| 24 | 98 | 78 | V | −95 | −139 | 2,827 | 410 |
| 28 | 98 | 78 | V | −92 | −133 | 2,999 | 435 |
| 35 | 98 | 78 | V | −95 | −139 | 2,572 | 373 |
| 36 | 98 | 78 | V | −87 | −124 | 2,875 | 417 |
| 34 | 98 | 78 | V | 10 | 50 | 2,572 | 373 |

*Conditions of PLNG at the lower end of flow line 23.

TABLE 3

| Stream | Percent of PLNG loaded into container 1 | Percent of PLNG in tank 11 | Vapor/ Liquid | ° C. | ° F. | kPa | psia |
|---|---|---|---|---|---|---|---|
| 23 @ bottom* | 0 | 0 | L | −95 | −139 | 2,999 | 435 |
| 24' | 0 | 0 | V | 95 | −139 | 2,999 | 435 |
| 28' | 0 | 0 | V | −96 | −140 | 897 | 127 |
| 35' | 0 | 0 | V | −95 | −139 | 1,303 | 189 |
| 40 | 0 | 0 | V | −44 | −48 | 3,103 | 450 |
| 34' | 0 | 0 | V | 10 | 50 | 1,303 | 189 |
| 23 @ bottom* | 49 | 0 | L | −95 | −139 | 2,999 | 435 |
| 24' | 49 | 0 | V | 95 | −139 | 2,910 | 422 |
| 28' | 49 | 0 | V | −96 | −140 | 2,158 | 313 |
| 35' | 49 | 0 | V | −95 | −139 | 1,062 | 154 |
| 40 | 49 | 0 | V | −29 | −20 | 3,103 | 450 |
| 34' | 49 | 0 | V | 10 | 50 | 1,062 | 154 |
| 26 | 49 | 0 | V | −91 | −132 | 3,103 | 450 |
| 22 | 49 | 0 | L | −96 | −140 | 3,103 | 450 |
| 23' @ bottom* | 98 | 0 | L | 95 | −139 | 2,999 | 435 |
| 24' | 98 | 0 | V | −95 | −139 | 2,827 | 410 |
| 28' | 98 | 0 | V | −92 | −133 | 2,999 | 435 |
| 35' | 98 | 0 | V | −95 | −139 | 897 | 127 |
| 40 | 98 | 0 | V | −8 | 18 | 3,103 | 450 |
| 34' | 98 | 0 | V | 10 | 50 | 2,944 | 427 |

*Conditions of PLNG at the lower end of flow line 23'.

TABLE 4

| Stream | Percent of PLNG loaded into container 1 | Percent of PLNG in tank 11 | Vapor/ Liquid | ° C. | ° F. | kPa | psia |
|---|---|---|---|---|---|---|---|
| 23" @ bottom* | 0 | 0 | L | −95 | −139 | 2,999 | 435 |
| 24" | 0 | 0 | V | −95 | −139 | 2,999 | 435 |
| 34" | 0 | 0 | V | −96 | −140 | 876 | 127 |
| 23" @ bottom* | 50 | 0 | L | 95 | −139 | 2,999 | 435 |
| 24" | 50 | 0 | V | 95 | −139 | 2,910 | 422 |
| 34" | 50 | 0 | V | −96 | −140 | 1,937 | 281 |
| 26 | 50 | 0 | V | −91 | −132 | 3,103 | 450 |
| 22 | 50 | 0 | L | −96 | −140 | 3,103 | 450 |
| 23" @ bottom* | 98 | 0 | L | −95 | −139 | 2,999 | 435 |
| 24" | 98 | 0 | V | −95 | −139 | 2,827 | 410 |
| 34" | 98 | 0 | V | −91 | −132 | 2,999 | 435 |

*Conditions of PLNG at the lower end of flow line 23".

A person skilled in the art, particularly one having the benefit of the teachings of this patent, will recognize many modifications and variations to the specific processes disclosed above. For example, a variety of temperatures and pressures may be used in accordance with the invention, depending on the overall design of the system and the composition of the PLNG. Return voyage conditions and reliquefaction operations will greatly influence the temperature and pressure in the containers. An additional variation in the mass left on the ship would occur if the vapor in the containers was providing the ship's fuel. Also, the piping connections between the PLNG containers may be supplemented or reconfigured depending on the overall design requirements to achieve optimum heat exchange requirements. As discussed above, the specifically disclosed embodiments and examples should not be used to limit or restrict the scope of the invention, which is to be determined by the claims below and their equivalents.

What is claimed is:

1. A method for loading pressurized liquefied gas into a plurality of containers containing pressurized vapor, wherein the containers are loaded in succession, comprising the steps of:

(a) introducing the liquefied gas into the containers, thereby discharging the vapor therefrom;

(b) passing vapor discharged from at least some of the containers to auxiliary storage tanks comprising a first tank and a second tank, withdrawing the vapor from at least one of the tanks, and passing the withdrawn vapor to a vapor utilization means; and (c) regulating fluid flow to and from the first and second tanks to assure that the total flow rate of vapor to the vapor utilization means remains at a relatively constant flow rate.

2. The method of claim 1 wherein the gas utilization means is a gas liquefaction plant which liquefies a gas feed stream.

3. The method of claim 2 wherein the flow rate of vapor to the gas liquefaction plant is a relatively constant flow rate as a percentage of the feed stream to the liquefaction plant.

4. The method of claim 1 wherein the vapor utilization means comprises fuel-consuming equipment.

5. The method of claim 1 further comprising, prior to step (a) an additional step of pressurizing the vapor in at least one of the containers to substantially the pressure of the liquefied gas to be introduced therein.

6. The method of claim 2 further comprising, prior to step (a) an additional step of cooling the pressurized vapor in at least one of the containers to substantially the temperature of the liquefied gas to be introduced therein.

7. The method of claim 1 further comprising, simultaneously with introducing the liquefied gas into a first container of the plurality of containers, the additional step of passing a fraction of the vapor discharged from the first container to a second container to be filled with the liquefied gas.

8. The method of claim 1 wherein the volumetric capacity of each tank is substantially the same as the volumetric capacity of a container of the plurality of containers.

9. The method of claim 1 further comprising pressurizing the vapor discharged from a first container of the plurality of containers by passing the discharged vapor to a compressor, separating said pressurized vapor into a first vapor stream and a second vapor stream, passing the first vapor stream to the vapor utilization means, heating the second vapor stream and passing the heated second vapor stream into a second container of the plurality of containers to increase the vapor pressure in the second container.

10. The method of claim 9 wherein the pressure in the second container is increased to substantially the same pressure as the bubble point pressure of the liquefied gas.

11. The method of claim 9 wherein the pressure in the second container is increased to substantially the same pressure as the bubble point pressure of the liquefied gas plus the pressure of the static head of the second container when filled with liquefied gas.

12. The method of claim 1 wherein the liquefied gas introduced into the first container is at least in part obtained by withdrawing liquefied gas from the second tank.

13. The method of claim 12, during withdrawal of the liquefied gas from the second tank, withdrawing a methane-rich vapor from the first storage tank, compressing the withdrawn methane-rich vapor, separating the compressed methane rich vapor into a first vapor stream and a second vapor stream, heating the first vapor stream and passing it back to the first storage tank, passing the second vapor stream to the second storage tank.

14. The method of claim 1 further comprising the steps of passing the vapor discharged from the last container being filled with pressurized liquefied gas to a compressor to pressurize the discharged vapor, passing a first fraction of the pressurized vapor to the vapor utilization means and heating a second fraction of the pressurized vapor and passing the heated second fraction to the second tank.

15. The method of claim 1 further comprising the step of regulating the pressure of the vapor displaced from the first container such that the pressure of the liquefied gas at the bottom of the containers remains essentially constant during loading of the liquefied gas into the first container.

16. The method of claim 1 wherein the temperature of the discharged vapor is above −112° C.

17. The method of claim 1 wherein the pressurized liquefied gas is pressurized liquefied natural gas having a temperature above −112° C. and a pressure at essentially its bubble point pressure.

18. The method of claim 1 further comprising, prior to step (a) the additional step of introducing heated vapor into the first container and maintaining the temperature of the temperature of the vapor in the container at or above a predetermined minimum temperature.

19. The method of claim 1 wherein the pressure of the vapor in the first container or group of containers at the beginning of the loading method is substantially the same as the bubble point pressure of the liquefied gas plus the hydrostatic head of a container full of liquefied gas.

20. The method of claim 1 further comprising regulating the pressure of the vapor introduced into the second tank to keep the pressure of the liquefied gas at the bottom of the tank essentially constant during loading of PLNG.

21. The method of claim 1 wherein the plurality of containers to be loaded with liquefied gas are aboard a ship and the auxiliary storage tanks are located off the ship.

22. The method of claim 1 further comprising regulating the pressure of the vapor in the second container to keep the pressure of the liquefied gas at the bottom of the second container essentially constant during loading of the liquefied gas therein.

23. A method for loading pressurized liquefied gas into a plurality of containers containing pressurized vapor, wherein the containers are loaded in succession, comprising the steps of:

(a) introducing the liquefied gas into a first container, thereby discharging the vapor therefrom;

(b) pressurizing the vapor discharged from the first container by passing the discharged vapor to a compressor, separating said pressurized vapor into a first vapor stream and a second vapor stream, passing the first vapor stream to a vapor utilization means, heating the second vapor stream and passing the heated second vapor stream into a second container of the plurality of containers to increase the vapor pressure in the second container;

(c) passing vapor discharged from at least some of the containers to auxiliary storage tanks comprising a first tank and a second tank, withdrawing the vapor from at least one of the tanks, and passing the withdrawn vapor to the vapor utilization means;

(d) regulating flow of fluids to and from the first and second tanks to buffer the flow rate of vapor to the vapor utilization means, wherein at the beginning of the method of loading the containers with liquefied gas, the first tank being filled with relatively high pressure vapor and the second tank containing pressurized liquefied gas, said fluid flow regulation comprising the steps of:

(i) withdrawing pressurized liquefied gas from the second tank and passing the withdrawn pressurized liquefied gas to at least one of the containers and simultaneously withdrawing vapor from the first tank, pressurizing the withdrawn vapor and passing a first fraction of the pressurized vapor to the second tank and heating a second fraction of the pressurized vapor and passing the heated second fraction to the first tank, at the end of this step the second tank being substantially emptied of pressurized liquefied gas and containing relatively high pressure vapor and the first tank containing relatively low pressure vapor;

(ii) withdrawing vapor from the second tank, pressurizing the vapor and passing a fraction of the pressurized vapor to the vapor utilization means and heating a second fraction of the pressurized vapor and passing the heated vapor to the second tank, at the end of this step the first and second tanks both containing vapor at a relatively low pressure;

(iii) passing the vapor discharged from the last container being filled with pressurized liquefied gas to a compressor to pressurize the vapor, passing a first fraction of the pressurized vapor to the vapor utilization means and heating a second fraction of the pressurized vapor and passing the heated second fraction to the second tank, at the end of this step, the first tank containing vapor at a relatively low pressure and the second tank containing vapor at a relatively high pressure; and (iv) introducing pressurized liquefied gas into the second tank and discharging vapor therefrom, pressurizing the discharged vapor of this step and splitting the vapor into a first fraction and a second fraction, heating the first vapor fraction and passing the heated first fraction to the first tank and passing the second fraction to the gas utilization means, at the end of this step, the first tank containing vapor at relative high pressure vapor and the second tank containing pressurized liquefied gas.

24. A method for loading pressurized liquefied gas into a plurality of containers filled with vapor rich in methane, wherein the containers are loaded in succession, comprising the steps of:

(a) introducing the liquefied gas into the containers, thereby discharging the vapor therefrom;

(b) passing a first fraction of the vapor discharged from the container to a vapor utilization means;

(c) passing a second fraction of the discharged vapor into auxiliary storage tanks comprising a first tank and a second tank, and passing at least a portion of the second vapor fraction from at least one of the auxiliary tanks to the vapor utilization means; and (d) controlling the amount of the first vapor fraction passed to the vapor utilization means relative to the amount of the second vapor fraction passed to the vapor utilization means to assure that the total flow rate of vapor to the vapor utilization means remains at a generally constant flow rate.

* * * * *